United States Patent [19]

Brunner

[11] Patent Number: 4,537,141

[45] Date of Patent: Aug. 27, 1985

[54] COMBUSTION CHAMBER FOR SOLID FUELS

[75] Inventor: Ernst Brunner, Mümliswil, Switzerland

[73] Assignee: TIBA AG Kochherdfabrik und Apparatebau, Bubendorf, Switzerland

[21] Appl. No.: 617,734

[22] Filed: Jun. 6, 1984

[30] Foreign Application Priority Data

Jun. 8, 1983 [CH] Switzerland ..... 3144/83

[51] Int. Cl.[3] ..... F23N 3/00

[52] U.S. Cl. ..... 110/300; 110/299

[58] Field of Search ..... 110/299, 300, 298; 126/163 R, 163 A

[56] References Cited

U.S. PATENT DOCUMENTS

| | | | |
|---|---|---|---|
| 949,402 | 2/1910 | Oliphant | 110/300 |
| 1,218,594 | 3/1917 | Carrick | 110/300 X |
| 1,523,137 | 1/1925 | Palmer | 110/300 |

*Primary Examiner*—Edward G. Favors

*Attorney, Agent, or Firm*—Cushman, Darby & Cushman

[57] ABSTRACT

A series of primary-air orifices (4) extend into the combustion chamber surrounded by a housing (1). A sloping bottom (6) and a grate (12), likewise inclined at an angle ($\alpha$), are located underneath. The grate consists of a row of parallel pipes (15*a* to 15*c*) which are arranged at a distance from one another and which are provided over their entire length with air outflow orifices (16*a*, 16*b*). A covering slide (13) sliding in grooves (17) on the grate makes it possible to cover to a greater or lesser extent both the gaps between the grate pipes (15*a* to 15*c*) and, if appropriate, some of the air outflow orifices provided in the grate pipes. The covering slide (13) can be actuated by hand or by means of a motor via a rack (20) connected rigidly to it and via a pinion (19). The primary-air orifices (4) are supplied with compressed air via a distributor (14) which can be regulated via a regulating slide (20) connected to the covering slide (13); in this way, the supply of primary air can be controlled as a function of the particular quantity of secondary air.

8 Claims, 6 Drawing Figures

1
2.
3.
4
5
6
7
8
9
10.
11
12
12'
13
13a
14
14a
18
19
20
1a
1a
G
Ps
S
α
II
II

COMBUSTION CHAMBER FOR SOLID FUELS

The present invention relates to a combustion chamber for solid fuels, with a housing, a closable charging orifice located in its top part, a grate arranged in the lower portion of the housing, and a plurality of primary-air orifices directed into the furnace and connected to a compressed-air source.

A combustion chamber which can be used to burn solid fuels should ideally allow the combustion cycle to be regulated in such a way that, whilst ensuring practically smokeless combustion, optimum efficiency is achieved. So that combustion can be influenced in all stages of the process, it is known, on the one hand, how to supply air, generally called "primary air", to kindle and maintain the fire. On the other hand, the air used for the afterburning of the combustion gases obtained is called "secondary air" in technical parlance.

The object of the present invention is to propose a combustion chamber which makes it possible to gain a better mastery of the cycle of the combustion process by means of an improved control of the same and, consequently, also to achieve a higher overall efficiency of the installation, whilst ensuring practically smokeless combustion and relatively high combustion temperatures.

The invention is defined in the independent patent claim. An exemplary embodiment of the subject of the invention, together with some alternative forms of construction, is described below with reference to the attached drawing.

Figure 1:
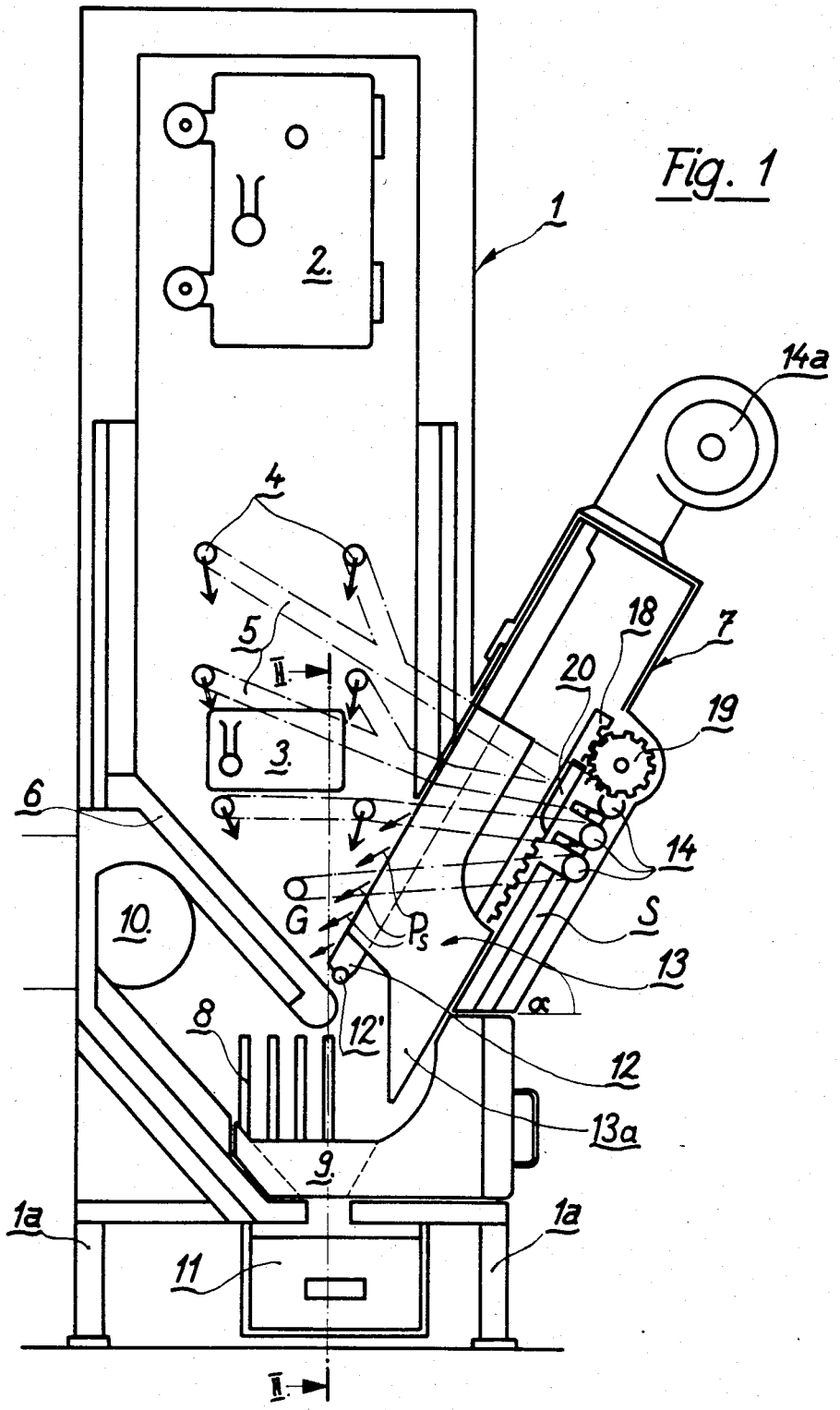
Figure 2:
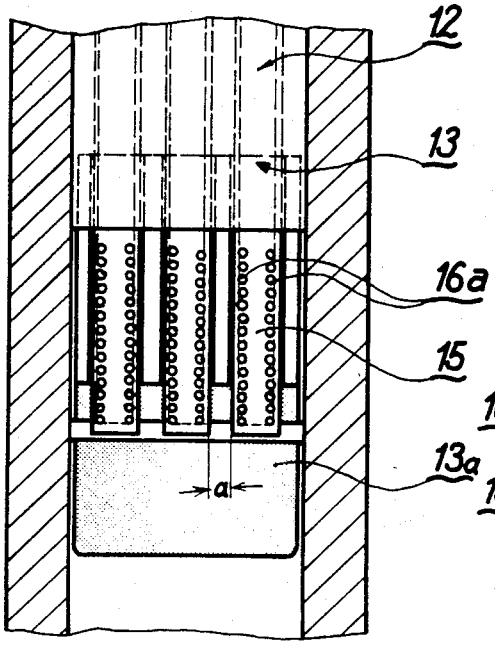
Figure 3:
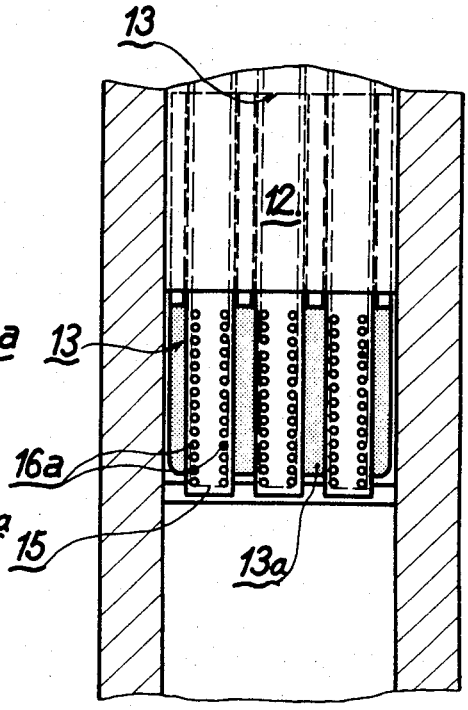
Figure 4:
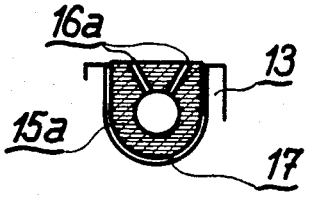
Figure 5:
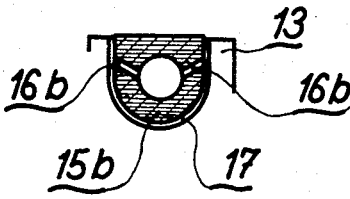
Figure 6:
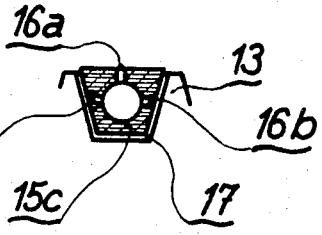

FIG. 1 is a simplified vertical section through an embodiment of the combustion chamber according to the invention, FIGS. 2 and 3 are plan views of the controllable grate in the direction of the arrows II—II in FIG. 1, and FIGS. 4 to 6 are sectional representations of different hollow profiles of the grate.

The combustion chamber, shown simplified, has a housing 1 which is supported on the ground via feet 1*a* and which is provided with a charging door 2 which can be closed in a gas-tight manner. Located below the latter is a somewhat smaller door 3 which can serve for the convenient introduction of the kindling wood and for occasionally observing the fire region. In the housing wall there are several orifices 4 which are connected by means of pipe connections 5, indicated by dot-and-dash lines, to a compressed-air distributor system yet to be described.

Located underneath the primary-air inflow region is a sloping bottom 6 which preferably has an inclination of 40° to 55° and which serves for guiding the burning fuel. Located opposite this sloping bottom is a control unit, designated as a whole by 7, which has, in addition to a grate 12, a covering slide 13 and a device for controlling primary and secondary air and which is described in more detail subsequently.

Swirl bars 8 for the additional swirling of the fire current and a pull-out fine-mesh grate 9 are arranged underneath the sloping bottom 6. This discharge of the combustion gases from the combustion chamber to the heat exchangers located after it is designated by 10. Underneath the fine-mesh grate 9 there is an ash drawer 11.

The control unit, designated as a whole by 7, comprises the grate 12, the covering slide 13, a compressed-air distributor 14 and a fan 14*a*. As shown in FIGS. 2 3, the grate 12 consists of a row of pipes 15 which are arranged parallel to and at a distance a from one another and which are provided with a plurality of air outflow orifices 16*a*/16*b*. The grate 12 is connected firmly to the housing 1 and is supported on a cross-member 12'.

The covering slide 13 is mounted underneath the grate 13 in such a way that it can move to and fro by means of a drive underneath the grate pipes 15 and thereby exposes or closes, depending on its position, on the one hand the gaps a existing between the grate pipes and on the other hand some of the air outflow orifices. FIG. 2 shows a plan view of the grate, with the covering slide 13 in the closing position, according to which the combustion chamber is operated at low power. According to the position of the retracted grate 12 illustrated in FIG. 3, the said grate exposes the gaps between the grate pipes and the air outflow orifices 16*b*, so that the combustion chamber is operated at high power. In its movement, the covering slide 13 slides on the grate pipes 15 by means of its grooves 17 (FIGS. 4 to 6) and at the same time is supported on sliding rails S located underneath the grate (FIG. 1). In the three embodiments of the grate pipes 15*a*, 15*b* and 15*c* illustrated in FIGS. 4 to 6, the outflow orifices 16*a* are directed so that the are open at all times, that is to say in any position of the covering element 13, whereas the orifices designated by 16*b* can be closed by the covering slide 13. Since the covering slide also exposes or closes the gaps a between the grate pipes, depending on its position, the air flow directed towards the lower furnace portion G can be regulated exactly with its assistance, and consequently the burn-up rate and the throughflow of combustion gases can be varied, whilst a practically constant combustion temperature is ensured.

Of course, it would also be possible to have an embodiment of the covering slide 13, according to which the slide would not be designed with sliding grooves 17 but would merely be guided laterally on the longitudinal edges of the slide.

The covering slide can be moved, for example, by means of a rack 18 connected rigidly to it and meshing with a pinion 19 which can itself be actuated by means of a crank handle or a motor. Other types of drive are known to a person skilled in the art and can be employed within the scope of the idea of the invention.

As also emerges from FIG. 1, the primary-air outflow orifices 4 are connected via the pipelines 5 to a compressed-air system 14, from which the supply of compressed air can be regulated by means of a regulating slide 20. Thus, depending on the position of the regulating slide 20 connected rigidly to the covering slide 13, the primary air also flows into the furnace at a controllable rate into the fire region, the secondary air and primary air being dependent on one another because of the relative position of the regulating slide 20. According to a preferred alternative form, the position of the regulating slide 20 on the covering slide 13 can be adjusted.

When the installation described is in operation, the combustion chamber is supplied with a controllable rate of air, as required, both in the primary-air part (outflow orifices 4) and in the secondary-air part (bed of burning fuel G), and both the burning-fuel sliding down on the sloping bottom 6 and the combustion gases obtained undergo effective afterburning as a result of the secondary air. At the same time, the secondary-air stream, represented by the arrows Ps, the outflowing feed rate of which is, for example, 20 to 60% of the rate of primary air, is directed counter to the primary-air stream, thus resulting in intimate mixing. The burning fuel falling through between the uncovered grate pipes 15 are supplied with secondary air over the entire width of the grate, so that a lack of oxygen cannot occur anywhere.

The grate 12, including the covering slide 13, consists of a heat-resistant material, preferably a suitable ceramic material. The angle of inclination $\alpha$ of the grate 12 can be, for example, between 45° and 80°, preferably between 65° and 70°. In any case, the grate should be steeper within the combustion chamber than the sloping bottom 6, so that the main load of the burning fuel can be absorbed by the sloping bottom. As indicated by the arrows Ps, the outflow orifices of the grate pipes are directed obliquely downwards, so that they are protected from being contaminated with ash. Instead of a grate consisting of individual pipes 15, a plate grate could also be used; this could consist of a flat box profile in which continuous slits are made.

A decisive advantage of the installation is also to be seen in the fact that the outflowing secondary air on the one hand cools the grate pipes and on the other hand is itself heated.

I claim:

1. A combination chamber for solid fuels, with a housing, a closable charging orifice located in its top part, a grate arranged in the lower portion of the housing, and a number of primary-air orifices directed into the furnace and connected to a compressed-air source, wherein the grate is designed as an air feeder and has an arrangement of hollow profiles which are connected to said compressed-air source and which are arranged at a distance from one another forming gaps and are provided with a number of air outflow orifices, a covering slide means being mounted in the region of the grate so as to be displaceable relative to the latter, in such a way that it more or less covers or completely exposes the gaps between the hollow profiles, depending on its position.

2. A combustion chamber as claimed in claim 1, wherein the grate, including the covering slide means, is inclined at an angle of 45° to 80° relative to the horizontal, and wherein a sloping bottom serving for guiding the burning fuel towards the grate is provided on the side of the combustion chamber located opposite the grate.

3. A combustion chamber as claimed in claim 1, wherein the grate has a number of practically parallel pipes which are provided with secondary-air outflow orifices and at least part of which is arranged so that it is covered by the covering slide in the closing position of the latter.

4. A combustion chamber as claimed in claim 3, wherein the covering slide is provided with grooves which extend parallel to the grate pipes and by means of which it is guided on the grate pipes.

5. A combustion chamber as claimed in claim 3, wherein the secondary-air outflow orifices of the grate pipes are directed obliquely downwards and essentially counter to the direction of flow of the primary air.

6. A combustion chamber as claimed in claim 1, wherein the covering slide is connected firmly to a rack meshing with a gear wheel which can be actuated by hand or by means of a motor.

7. A combustion chamber as claimed in claim 1, wherein the said covering slide has coupled to it at least one further regulating member which controls the supply of primary air to the primary-air outflow orifices opening into the furnace, as a function of the particular quantity of secondary air supplied.

8. A combustion chamber as in claim 2 wherein the grate, including the slide means, is inclined at an angle of 65° to 70° relative to the horizontal.

* * * * *